US006530248B1

(12) United States Patent
Parker

(10) Patent No.: US 6,530,248 B1
(45) Date of Patent: Mar. 11, 2003

(54) LOCK DEVICE

(75) Inventor: Julian Parker, Aberdeen (GB)

(73) Assignee: Tayhope Enterprises Limited, Aberdeen (GB)

( * ) Notice: Subject to any disclaimer, the term of this patent is extended or adjusted under 35 U.S.C. 154(b) by 0 days.

(21) Appl. No.: 09/913,806

(22) PCT Filed: Feb. 16, 2000

(86) PCT No.: PCT/GB00/00536

§ 371 (c)(1),
(2), (4) Date: Aug. 17, 2001

(87) PCT Pub. No.: WO00/49255

PCT Pub. Date: Aug. 24, 2000

(30) Foreign Application Priority Data

Feb. 18, 1999 (GB) ..... 9903609

(51) Int. Cl.[7] ..... E05B 73/00

(52) U.S. Cl. ..... 70/14; 70/18; 70/54; 70/56; 70/38 R; 70/38 A; 70/38 C; 70/39; 70/41; 70/42

(58) Field of Search ..... 70/14, 18, 54, 70/56, 38 R, 38 A, 38 B, 38 C, 39, 41, 42

(56) References Cited

U.S. PATENT DOCUMENTS 3,667,259 A * 6/1972 Reque et al. ..... 292/288
3,889,497 A * 6/1975 Tuttle ..... 70/14
3,988,031 A * 10/1976 Meyer ..... 292/148
4,085,599 A * 4/1978 Fischer et al. ..... 70/14
4,920,772 A 5/1990 Denison
5,020,342 A * 6/1991 Doan et al. ..... 24/601.7
5,365,757 A * 11/1994 Primeau ..... 292/307 R
5,582,042 A 12/1996 Mordick
5,839,302 A * 11/1998 Chu ..... 70/339
D415,949 S * 11/1999 Reed ..... D8/333

FOREIGN PATENT DOCUMENTS

EP 0 831 199 A2 3/1998

* cited by examiner

*Primary Examiner*—Anthony Knight
*Assistant Examiner*—Christopher Boswell
(74) *Attorney, Agent, or Firm*—Blackwell Sanders Peper Martin LLP

(57) ABSTRACT

This invention relates to a lock assembly to be used in conjunction with two or more padlock assemblies. The lock assembly comprises a main body 1, a main shackle 2, and a locking portion 7. When all subsidiary padlocks 5, 6 are locked into the apertures 3, 4 the main shackle 2 cannot be opened. The removal of either subsidiary shackle allows the locking portion 7 to circumvent the second subsidiary shackle and the main shackle 2 may be opened. This allows two persons to independently use the padlock without sharing keys or other secure information. Moreover the lock assembly may be used with any secure fitting designed for use with a traditional padlock.

26 Claims, 7 Drawing Sheets

LOCK DEVICE

BACKGROUND OF THE INVENTION

This invention relates to a lock device and particularly to a lock assembly to be used in conjunction with two or more padlock assemblies.

Padlock assemblies are in common use today and comprise a fastening member in the form of a shackle which is moveable relative to a main body between closed and open positions. A lock is mounted in the main body and can lock the shackle in the closed position. Such assemblies are widely used in a variety of applications to restrict the unauthorized relative movement of two or more members such as a hasp and staple fitting, or hasp and padbar fitting. Such secure fittings for use with padlock assemblies provide an aperture through which the padlock assembly's shackle can be passed. When the padlock shackle is passed through such an aperture, closed and locked, the unauthorized removal of the padlock assembly is relatively assured.

Situations can arise where it is desirable to use two or more independently operable padlocks so that the removal of only one padlock allows the operation or free movement of the secure fitting. The advantage of this is that two or more unauthorized users can operate the secure fitting without sharing keys, codes or other such secure method of lock operation. Conventional secure fittings are normally designed to be used with a single padlock assembly.

BRIEF SUMMARY OF THE INVENTION

According to the present invention there is provided a lock device comprising a body member and a fastening member; the fastening member being received in the body member and being moveable axially relative to the body member between a first open position and a second closed position, the fastening member having a locking formation adapted to engage one or more locking arms when received in the body member so that when the fastening member is in the second closed position and the or each locking arm is engaged with the fastening member, the fastening member cannot be moved into said first open position; and wherein disengaging one of the locking arms permits the fastening member to be moved transaxially in order to move to the first open position.

Preferably there are two or more locking arms and disengaging one of them permits transaxial movement of the locking formation past the other.

In a first embodiment the locking arms can be padlock shackles or bolts extending through apertures through the device to which padlocks are attached thereby locking them to the device.

The transaxial movement may be rotation or simple movement in a straight line across the axis of movement of the fastening member between the open and closed positions.

Optionally the lock device is a double padlock device or a triple padlock device.

Optionally the body member contains two or three separate apertures, but a single slot for receiving two or more padlock shackles or bolts can be used. Alternatively up to three apertures may be provided.

Preferably the body member is a hollow casing.

Preferably the body member is manufactured from steel.

Preferably there are two additional apertures on the top side of the body member and typically these receive the fastening member. The apertures can typically be elongate so as to allow transaxial movement of the fastening member.

Preferably the fastening member is a shackle. Most preferably the shackle is U-shaped. Preferably the fastening member and the locking formation are permitted to rotate with respect to one another to aid release of the fastening member. Typically the rotation means comprises a circlip or a grub screw.

Preferably the locking formation has an elongate portion, and most preferably has a shoulder portion also. The shoulder portion typically extends laterally from the elongate portion, typically at the end. The shoulder portion is typically engaged by one of the shackles. Typically two apertures are provided side-by-side in the body member so that shackles engaged therein pass on either side of the elongate portion and at least one passes over the shoulder portion, to retain the fastening member in the body member. The other of the shackles passing on the other side of the elongate portion prevents rotational (or other transaxial) movement of the fastening member past the first shackle. Removal of the other (second) shackle permits rotation (or other transaxial movement) of the shoulder past the first. Removal of the first shackle permits simple axial sliding movement of the fastening member from the body to open the device.

In an second embodiment locks may be contained within the body member instead of padlocks or bolts passing through apertures in the body. Optionally the lock device may contain 2 or 3 locks or more. Typically the locks are barrel locks. The locking arms typically comprise cams, normally positioned on the top of the locks.

Optionally the locks are disposed in separate sockets in the body. Normally the sockets are in the bottom of the body member.

Typically the locking arms (e.g. the cams) can move from a first configuration to a second configuration. In the first configuration the shoulder portion is typically engaged by one of the cams. Typically the cams are positioned on either side of the elongate portion and at least one passes over the shoulder portion, to retain the fastening member in the body member. The other of the cams passing on the other side of the elongate portion prevents rotational (or other transaxial) movement of the fastening member past the first shackle. Rotation or sliding of the other (second) cam into the second configuration disengages the second cam from the elongate portion and so permits rotation (or other transaxial movement) of the shoulder past the first cam to open the device. Rotation or sliding of the first cam into the second configuration disengages the shoulder portion and so permits simple axial sliding movement of the fastening member from the body to open the device.

In a further embodiment at least one locking arm may be a padlock shackle or bolt through the device to which a padlock is attached thereby locking it to the device and at least one locking arm comprises a cam.

Preferably the padlock shackle or bolt has the features described for the first embodiment.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
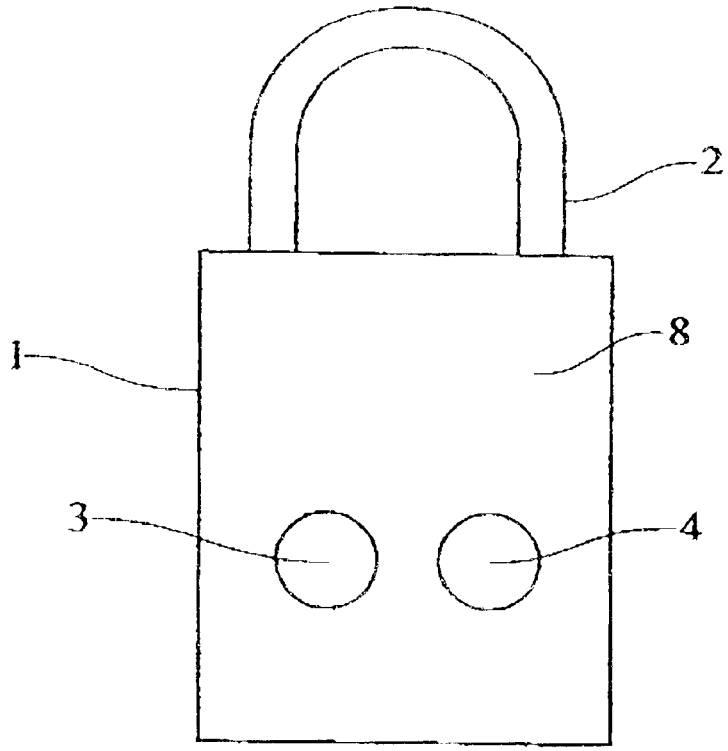
FIG. 1 shows a front elevation of a lock device according to the first embodiment of the invention in a closed position with no padlock assemblies fitted.
Figure 2:
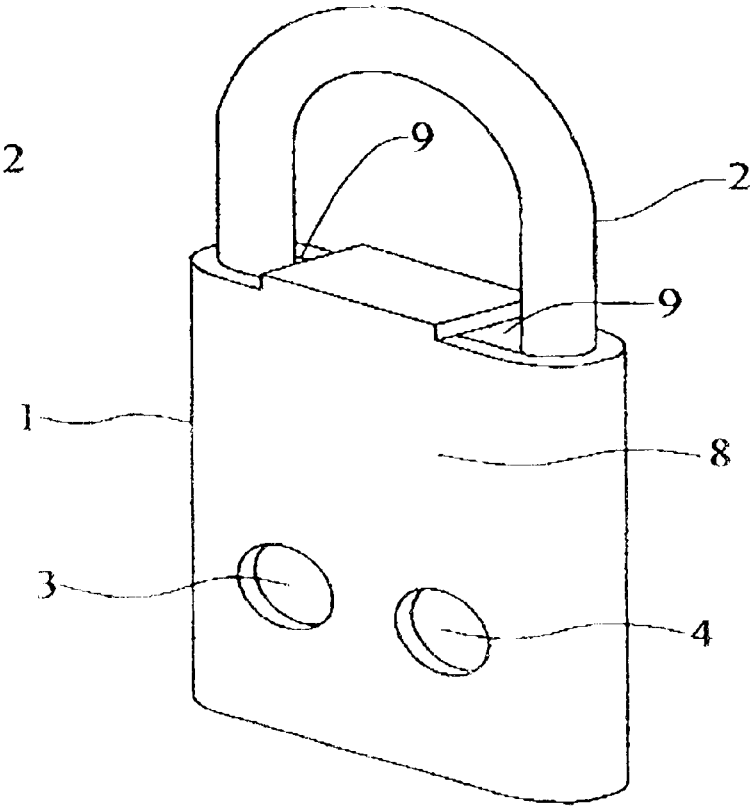
FIG. 2 shows a perspective view of the lock device of FIG. 1.

Referring to FIGS. 1 to 6, a multiple padlock device comprises a main body 1, a fastening member in the form of main shackle 2 received in the body 1 via two holes 9 on the upper surface of the main body 1, and a locking formation 7. The main body 1 is normally a hollow rectangular casing containing two apertures 3, 4 on each main face 8. The apertures 3, 4 are each designed to allow the shackle of a respective padlock 5, 6 to pass through. The main body 1 may be made from steel or any other suitably robust material, particularly metals. It can be manufactured by cast molding or from sheet metal, or by any other suitable method.

The main shackle 2 is normally U-shaped and can be made from steel or any other robust material, particularly metals. On the inner end of the main shackle 2 is a locking formation 7. The locking formation 7 and main shackle 2 are normally manufactured together by cast molding or any other suitable means, but may be made separately and joined together e.g. by welding.

Figure 3:
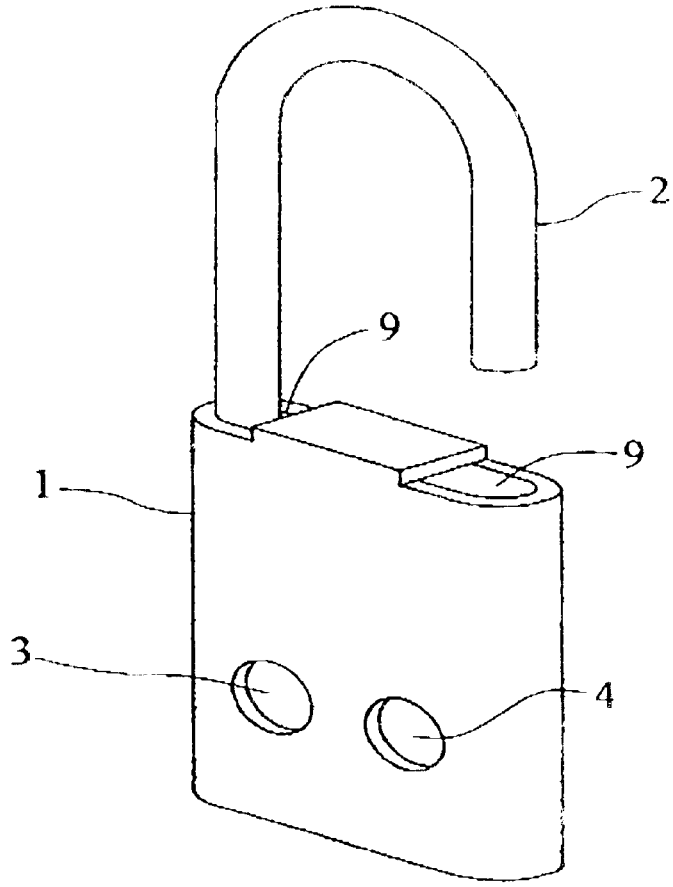
FIG. 3 shows a perspective view of the lock device of FIGS. 1, 2 in an open position.

The main shackle 2 can move in the body 1 between a first open position as shown in FIG. 3 or in a second closed position as shown in FIG. 1.

Figure 4:
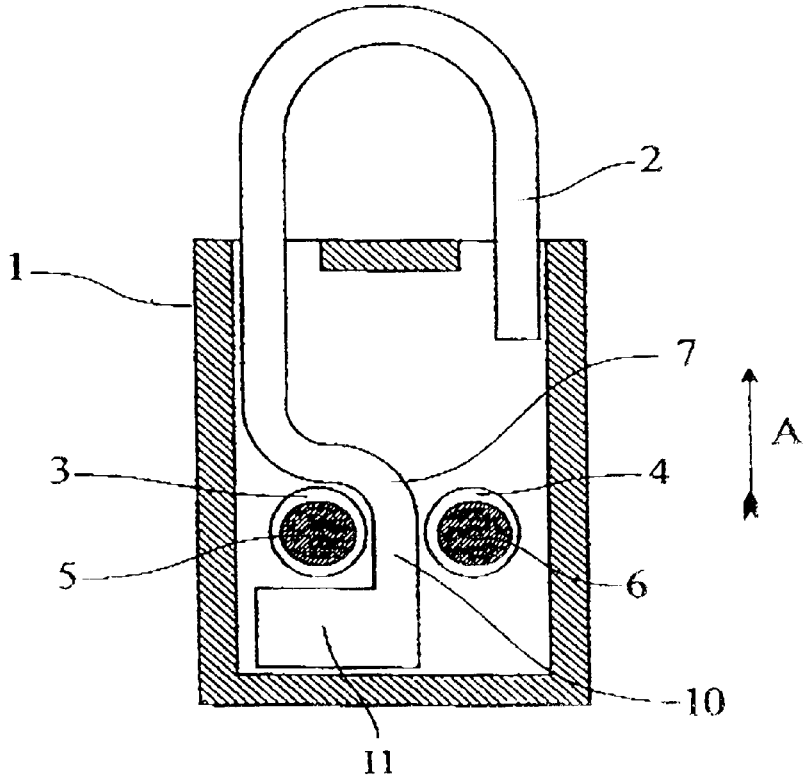
FIG. 4 shows a front sectional view through the FIG. 1 device in a closed position with two padlock assemblies fitted.

The locking formation 7 has an elongate portion 10 and a shoulder 11 designed to loop around a shackle 5 of a first padlock as shown in FIG. 4.

FIG. 4 shows the main shackle 2 in its closed position with first and second padlock shackles 5, 6 passing through each of the shackle apertures 3, 4. In this configuration the main shackle 2 cannot move to the open position.

Movement of the main shackle 2 in the direction of arrow A in FIG. 4 is resisted by the shoulder 11 abutting against the first shackle 5. The main shackle 2 cannot rotate or move diagonally because the elongate portion 10 abuts against the second padlock shackle 6.

Figure 5:
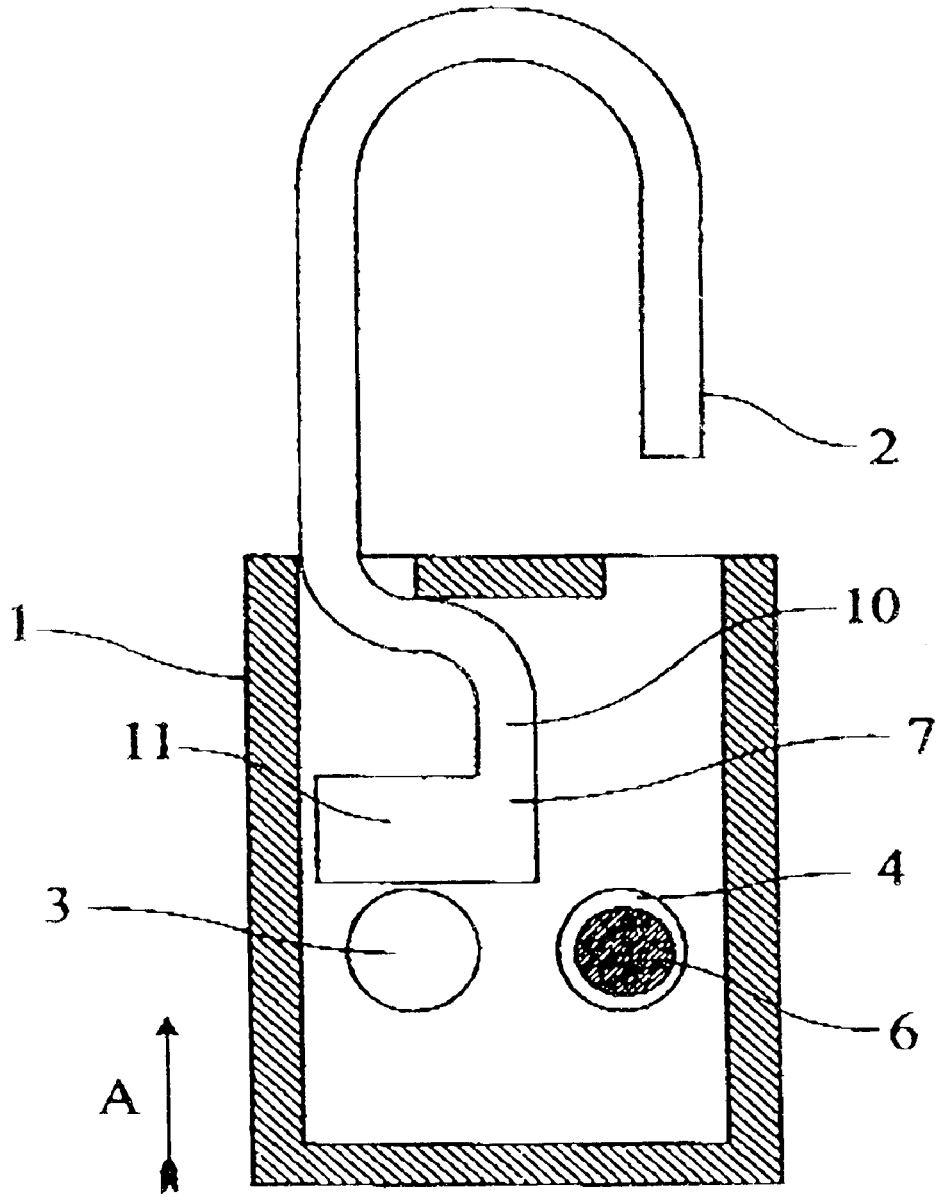
FIG. 5 shows a front sectional view through the FIG. 1 device in an open position with the left hand padlock assembly removed.

When the first padlock 5 is removed the shoulder 11 is no longer restrained by it, and the main shackle 2 may move to the open position simply by sliding in the direction of arrow A, as shown in FIG. 5. This movement does not require unlocking of the second padlock 6 as there is no shoulder on the other side of the elongate portion 10 and the locking formation 7 can simply move past the second padlock 6.

When the padlock 6 is removed the locking formation 7 is still retained by the shoulder 10 abutting against the first shackle 5 but it can rotate or slide obliquely away in the direction of arrow B from the remaining padlock assembly shackle 5.

Figure 6:
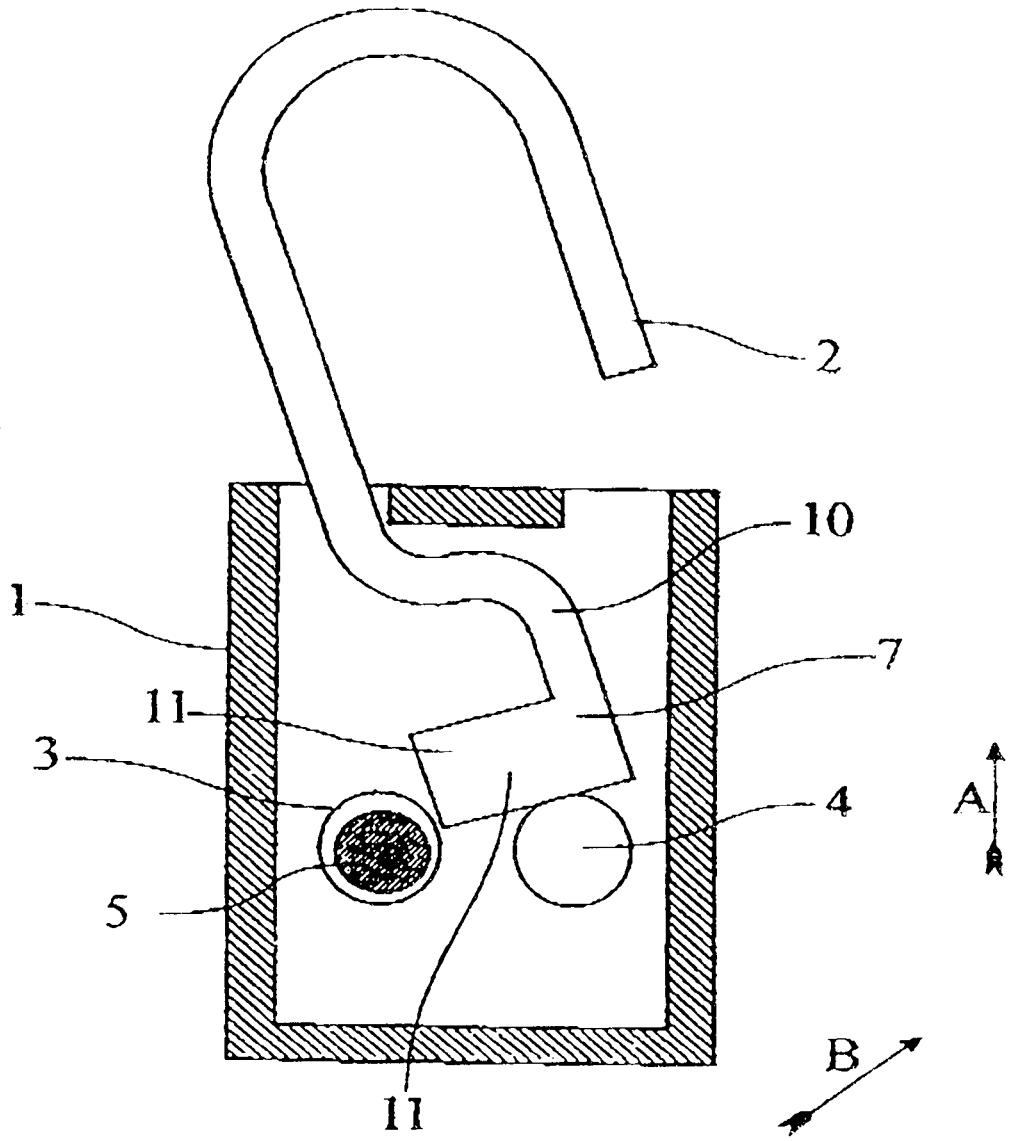
FIG. 6 shows a front sectional view through the FIG. 1 device in an open position with the right hand padlock assembly removed.

This allows the shoulder 11 to move past the shackle 5 and allows the subsequent movement of the main shackle in the direction of arrow A as shown in FIG. 6.

Alternatively the shoulder 11 may abut against the second shackle 6 (not shown). The locking mechanism would function in the same way.

To allow the shackle to be inserted into the main body two apertures 9 are present on the topside of the main body 1. These apertures are typically large enough to allow the shackle to tilt as shown in FIG. 6 when the second subsidiary shackle 6 is removed.

Two independent persons without sharing keys, codes or the like can therefore operate the padlock fastening device.

Figure 7:
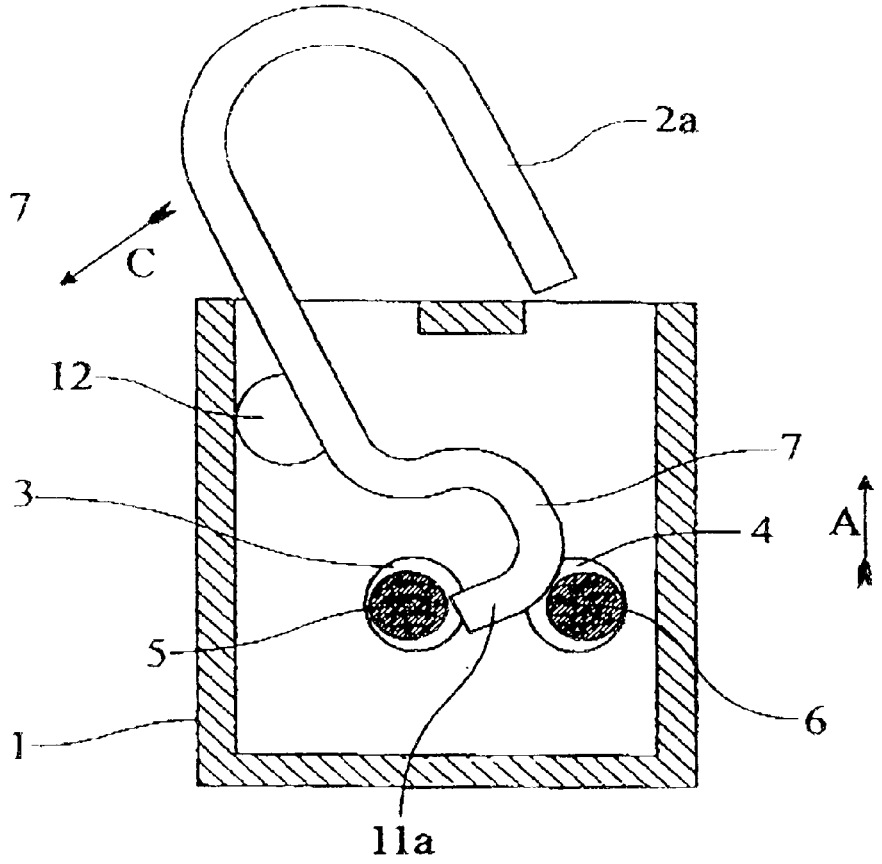
FIG. 7 shows a front sectional view through a lock device according to a second embodiment in an open position with the uppermost padlock assembly removed.
Figure 8:
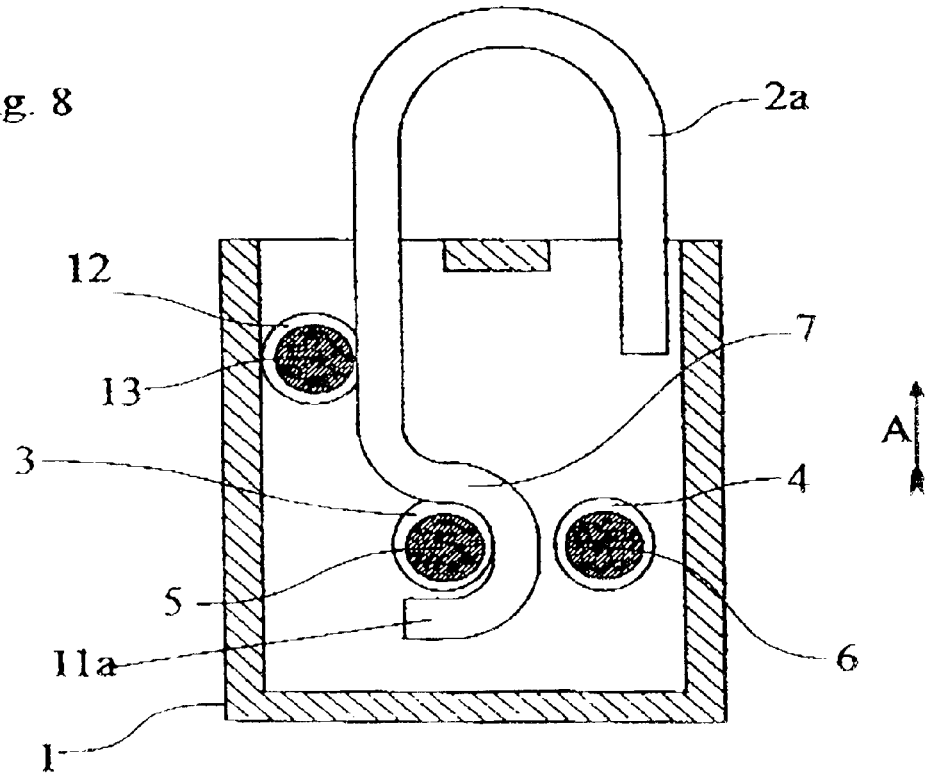
FIG. 8 shows a front sectional view through the FIG. 7 device in a closed position with padlock assemblies fitted.

A second embodiment of the invention is shown in FIGS. 7 & 8.

This embodiment differs from the first embodiment in that an extra aperture 12 is provided into which a third padlock shackle 13 may be inserted as shown in FIG. 8.

When all the subsidiary shackles 5, 6, 13 are in place and when the main shackle 2*a* is in its closed position the main shackle 2*a* cannot be released.

Attempting to remove the main shackle 2*a* in an upwardly vertical direction is resisted by the shackle 5 abutting against the shoulder 11 a as described above.

The main shackle 2 cannot slide obliquely to enable the shoulder 11 to bypass the shackle 5 because the locking formation 7 abuts against the second shackle 6 if the locking formation is moved to the right. The main shackle 2*a* itself abuts against the third shackle 13 if it is moved to the left.

Thus with all padlock shackles 5, 6, 13 locked in their respective apertures the main shackle 2*a* is secured.

The removal of either of the first or second shackles 5, 6 allows the release of the main shackle 2*a* as described above in relation to the first embodiment.

The removal of the third shackle 13 allows the release of the main shackle 2*a* by permitting the main shackle 2*a* to move transaxially to the left in the direction of arrow C as shown in FIG. 7. This permits the shorter shoulder 11*a* to move between the shackles 5 and 6 as the main shackle 2*a* is moved axially in the direction of arrow A.

Three independent persons without sharing keys, codes or the like can therefore operate the lock device according to the second embodiment.

Figure 9:
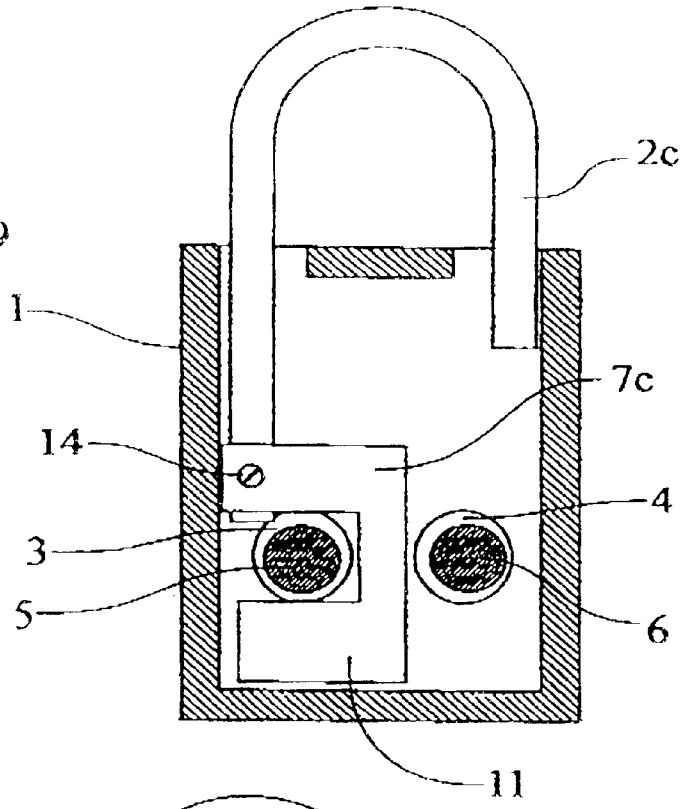
FIG. 9 shows a front sectional view of a third embodiment of a locking device in a closed position with two padlock assemblies fitted.
Figure 10:
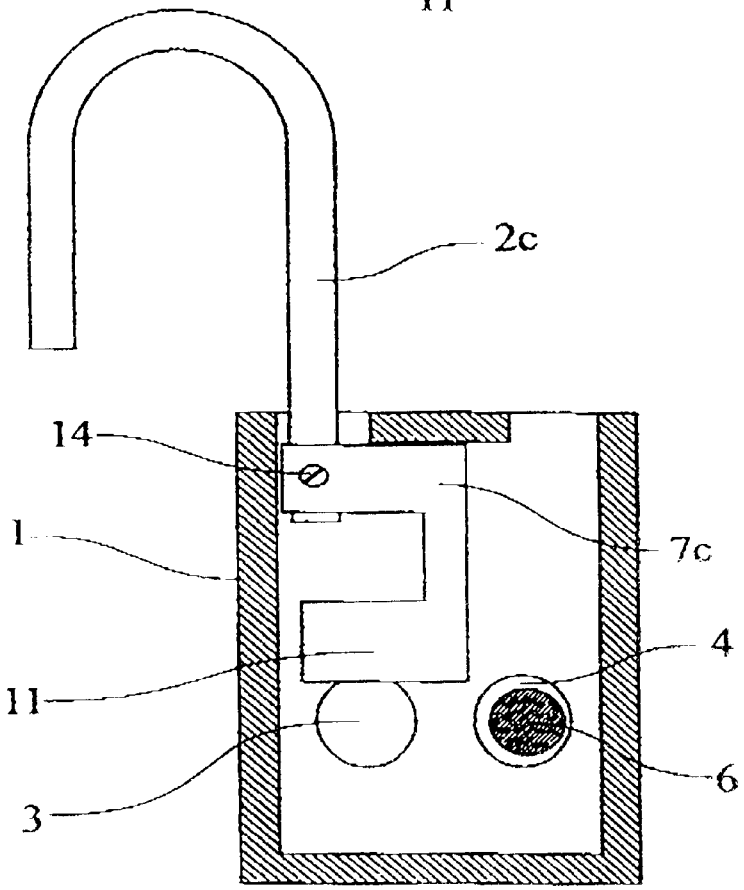
FIG. 10 shows a front sectional view of the third embodiment of the device in an open position with the left hand padlock assembly removed.

A third embodiment of the invention is shown in FIGS. 9 & 10.

The third embodiment functions in the same manner as the first embodiment except that the locking formation 7 and main shackle 2*c* are attached together by a circlip (not shown) or grub screw 14 as shown in FIGS. 9–12. This allows rotation between the shackle 2*c* and the locking formation 7*c* which eases the release of the shackle from the hasp or other fitting it secures.

Figure 11:
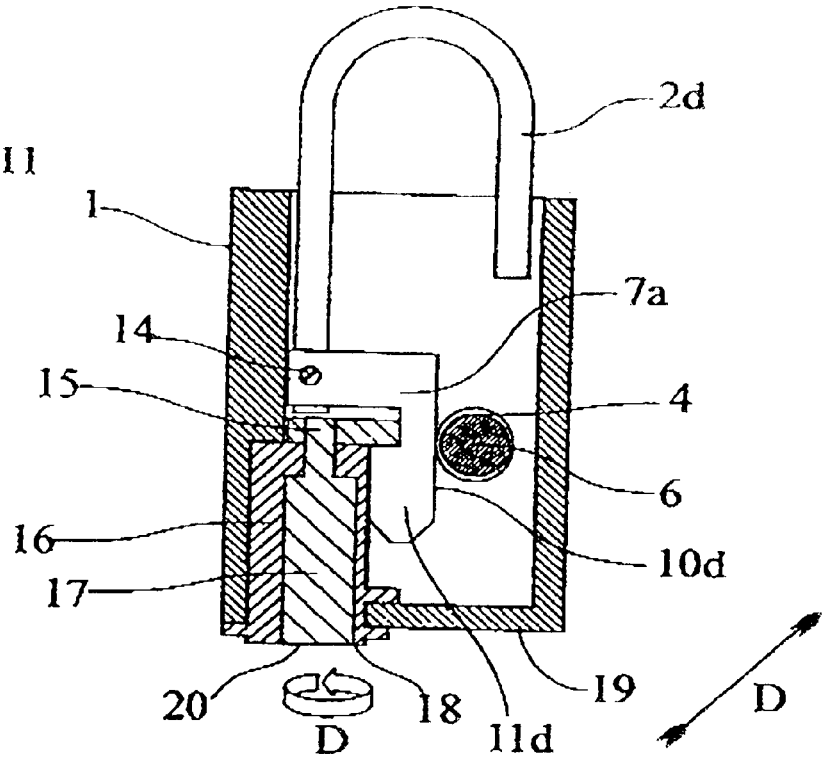
FIG. 11 shows a front sectional view of a fourth embodiment of a device in a closed position.
Figure 12:
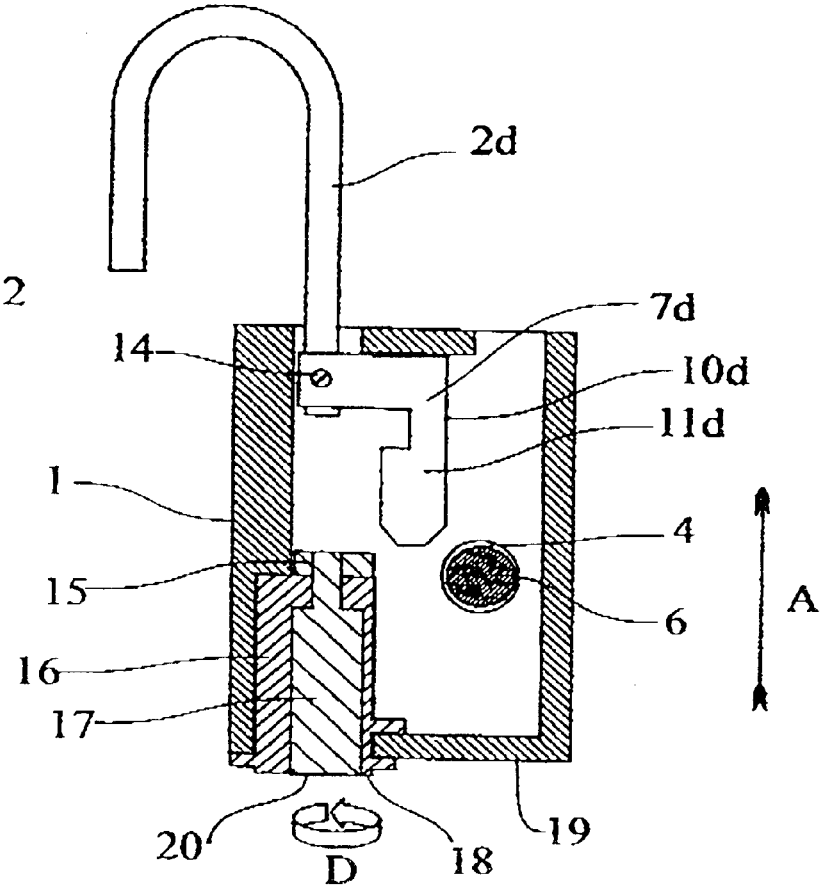
FIG. 12 shows a front sectional view of the fourth embodiment in an open position.

A fourth embodiment is shown in FIGS. 11 & 12. The fourth embodiment is similar to the third embodiment and so like parts will not be described further. The aperture 3 present in other embodiments is not needed in the fourth embodiment.

A barrel lock 17 is located in a socket 16 in the main body 1 through an aperture 18 in its bottom face 19. The barrel lock 17 is mounted in the main body 1 so that the bottom of the barrel lock 17 is exposed to the outside of the device.

A keyhole 20 is provided at the exposed portion of the barrel lock 17. The barrel lock 17 has a lockable arm in the form of a cam 15 mounted on its upper end, movable between a locked position (shown in FIG. 11) and an unlocked position (shown in FIG. 12). The locking formation 7*d* comprises an elongate portion 10*d* and a shoulder portion 11*d* designed to loop around the cam 15 in its locked position. When the cam 15 is in this locked position it abuts with the shoulder portion 11*d* to resist axial movement of the shackle as shown in FIG. 11. The elongate portion 10*d* of the locking formation 7*d* abuts against the padlock bar 6 in the aperture 4 to resist transaxial movement of the locking formation 7*b* in a similar manner to the first embodiment. Therefore the device is locked.

On turning the key in the direction of arrow D the arm rotates and disengages the fastening member 11*b*. The fastening member 11*b* may then be withdrawn axially as shown in FIG. 12.

Instead of disengaging the cam 15 the padlock bar 6 may be removed instead. Transaxial movement of the locking formation 7*d* in the direction of arrow D is then permitted allowing the shackle 2*d* to be released in the same manner as that of the first embodiment.

Additional barrel locks can be used instead of the padbar 6 and apertures 4. For each barrel lock included an aperture in any suitable face, normally the bottom face, is provided for access to the keyhole. The apertures 6 and/or 12 are thus not required when a barrel lock is used instead of separate padlocks.

Certain embodiments of the invention allow two or more padlock assemblies to be used independently to lock a secure fitting designed for use with only one padlock assembly, whereby the unlocking of any padlock assembly enables the operation or free movement of the secure fitting.

Certain embodiments of the present invention may be used for secure fittings which are designed for traditional padlocks and is therefore immediately applicable to a variety of secure fittings. This eliminates the need to adapt secure fittings which would be inconvenient and incur additional expenditure.

These and other modifications and improvements can be incorporated without departing from the scope of the invention.

What is claimed is:

1. A lock device comprising a body member and a fastening member;

the fastening member being received in and retained by the body member and being moveable axially relative to the body member between a first open position and a second closed position, the fastening member being retained by the body member in both of the first open and second closed positions, the fastening member having a locking formation adapted to engage at least one locking arm when received in the body member so that when the fastening member is in the second closed position and at least one locking arm is engaged with the fastening member, the fastening member cannot be moved into said first open position and wherein disengaging one of the locking arms permits the fastening member to be moved transaxially in order to move to the first open position.

2. The lock device as claimed in claim 1 wherein there are at least two locking arms and disengaging one of them permits transaxial movement of the locking formation past the other.

3. The lock device as claimed in claim 1 wherein the transaxial movement includes rotation across the axis of movement of the fastening member between the open and closed positions.

4. The lock device as claimed in claim 1 wherein the transaxial movement is in a straight line across the axis of movement of the fastening member between the open and closed positions.

5. The lock device as claimed in claim 1 wherein the body member is manufactured from steel.

6. The lock device as claimed in claim 1 wherein the fastening member and the locking formation can rotate with respect to each other.

7. The lock device as claimed in claim 1 having at least one aperture on the body member to receive the fastening member.

8. The lock device according to claim 7, wherein the at least one aperture in the body member permits tilting movement of the fastening member in the aperture.

9. The lock device as claimed in claim 1 wherein the fastening member is a shackle.

10. The lock device as claimed in claim 9 wherein the shackle is U-shaped.

11. The lock device as claimed in claim 1 wherein the locking formation has an elongate portion.

12. The lock device as claimed in claim 1 wherein the locking formation has a shoulder portion.

13. The lock device as claimed in claim 12 wherein the shoulder portion is engaged by one of the locking arms.

14. The lock device as claimed in claim 1 wherein at least one of the locking arms includes a padlock shackle.

15. The lock device as claimed in claim 14 wherein the lock device can receive 2 or 3 lockable bars.

16. The lock device as claimed in claim 14 wherein two apertures for receiving lockable bars are provided side-by-side in the body member so that first and second lockable bars engaged therein can pass on either side of the elongate portion of the fastening member and at least one lockable bar can pass over the shoulder portion, to restrain axial movement of the fastening member in the body member by means of the shoulder abutting against the first lockable bar, and to restrain transaxial movement of the fastening member by means of the elongate portion abutting against at least one of the lockable bars.

17. The lock device according to claim 16, having a third lockable bar received in a third aperture in the body, and engaging a portion of the fastening member to restrain transaxial movement of the fastening member.

18. The lock device according to claim 17, wherein the third lockable bar restrains transaxial movement in the opposite direction to that restrained by the first and second bars.

19. The lock device as claimed in claim 1 wherein the body member contains 2 or 3 locks.

20. The lock device as claimed in claim 19 wherein at least one of the locks includes a barrel lock.

21. The lock device as claimed in claim 20 wherein at least one of the locking arms includes a cam.

22. The lock device as claimed in claim 19 wherein the locking arms are positioned on either side of the elongate portion and at least one passes over the shoulder portion, to restrain the fastening member in the body member by means of the shoulder abutting against a first locking arm, and wherein transaxial movement of the fastening member is restrained by the elongate portion abutting against at least one of the locking arms.

23. The lock device according to claim 22, having a third locking arm engaging a portion of the fastening member to restrain transaxial movement of the fastening member.

24. The lock device according to claim 23, wherein the third locking arm restrains transaxial movement in the opposite direction to that restrained by the first and second locking arms.

25. The lock device as claimed in claim 19, wherein at least one of the locks includes a padlock and at least one of the locking arms is the hasp of a padlock.

26. The lock device as claimed in claim 7, wherein a portion of the locking formation cannot pass through the at least one aperture, thus retaining the fastening member in the body member in both the first open and second closed positions.

* * * * *